US010195735B2

(12) United States Patent
Jenkins

(10) Patent No.: US 10,195,735 B2
(45) Date of Patent: Feb. 5, 2019

(54) SOCKET HEAD STORAGE AND PORTAGE APPARATUS

(71) Applicant: Joshua Jenkins, Troy, IL (US)

(72) Inventor: Joshua Jenkins, Troy, IL (US)

( * ) Notice: Subject to any disclaimer, the term of this patent is extended or adjusted under 35 U.S.C. 154(b) by 45 days.

(21) Appl. No.: 15/584,325

(22) Filed: May 2, 2017

(65) Prior Publication Data

US 2018/0319006 A1 Nov. 8, 2018

(51) Int. Cl.
*B25H 3/06* (2006.01)
*B65D 85/20* (2006.01)
*B25H 3/02* (2006.01)

(52) U.S. Cl.
CPC ..... *B25H 3/06* (2013.01); *B25H 3/023* (2013.01); *B65D 85/20* (2013.01)

(58) Field of Classification Search
CPC . B25H 3/06; B25H 3/00; B25H 3/023; B25H 3/02; B25H 3/021; B25H 3/022; B25H 3/04; B65D 85/20
USPC ..... 206/378
See application file for complete search history.

(56) References Cited

U.S. PATENT DOCUMENTS 5,316,143 A * 5/1994 Horn ..... B25H 3/06 206/350
5,368,164 A * 11/1994 Bennett ..... B25H 3/003 206/373
5,456,359 A * 10/1995 Horn ..... B25H 3/06 206/350
5,573,116 A * 11/1996 Zink ..... B25H 3/06 206/377
6,092,656 A * 7/2000 Ernst ..... B25H 3/06 206/378
6,364,109 B1 * 4/2002 Blackwell ..... B25H 3/003 206/378
8,307,980 B1 * 11/2012 Kao ..... B25H 3/04 206/372
8,408,388 B1 * 4/2013 Chen ..... B65D 25/103 206/376
8,550,244 B1 * 10/2013 Ou ..... B65D 71/50 206/378
8,556,075 B1 * 10/2013 Ou ..... B65D 73/0064 206/372
9,126,739 B2 * 9/2015 Chao-Ming ..... B65D 85/02
9,434,065 B2 * 9/2016 Ou ..... B25H 3/04
(Continued)

*Primary Examiner* — Steven A. Reynolds
*Assistant Examiner* — Javier A Pagan
(74) *Attorney, Agent, or Firm* — Williams Intellectual Property; Benjamin F. Williams

(57) ABSTRACT

A socket head storage and portage apparatus is provided wherein a plurality of socket heads is selectively securable and conveniently locatable proximal a user. A body member includes a first lateral side and a second lateral side. A plurality of first apertures is disposed upon the first lateral side, each devised for accommodation of a particularly sized socket head, and a plurality of second apertures is similarly disposed upon the second lateral side. A medial wall member, disposed interiorly along a medial longitudinal axis bisecting the body member, secures each of the plurality of socket heads in contact therewith. A bar member spanning a U-shaped notch in a top side, a pair of hook members securable into a rear side, and at least one magnetic member disposed upon the front side, enable selective attachment to a variety of objects and surfaces in proximity to a user at a job site.

8 Claims, 5 Drawing Sheets

(56) References Cited

U.S. PATENT DOCUMENTS

| | | | | |
|---|---|---|---|---|
| 9,522,467 | B1 * | 12/2016 | Kao | A47F 7/0028 |
| 9,573,270 | B2 * | 2/2017 | Ou | B25H 3/003 |
| 2002/0130231 | A1 * | 9/2002 | Winnard | B25H 3/04<br>248/206.5 |
| 2010/0170817 | A1 * | 7/2010 | Wu | B25H 3/003<br>206/378 |
| 2014/0209780 | A1 * | 7/2014 | Chang | A47F 5/0823<br>248/551 |
| 2015/0122750 | A1 * | 5/2015 | Kao | B25H 3/04<br>211/13.1 |
| 2015/0258678 | A1 * | 9/2015 | Wang | B25H 3/06<br>206/378 |

* cited by examiner

SOCKET HEAD STORAGE AND PORTAGE APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of tool boxes, socket, ratchet, and socket head storage devices and apparatuses are known in the prior art. Most require opening an enclosed case or other enclosure to access socket heads stored by diameter or size in corresponding securable compartments. Portability, when extant, is typically enabled by use of handles. Most such carrying cases resemble briefcases or tool boxes or other portable containers and lack means to secure said case or box or other portable container to an existing object or surface and remain securely situated proximal a user on a jobsite.

What is needed is a socket head storage and portage apparatus that releasably secures to overhead poles, pipes, wires, and other elongate bodies or brackets, for example, by clipping or tied engagement at a bar member disposed spanning a U-shaped notch; by hooked engagement over top of a wall or other object capable of securing each of a pair of hook members thereatop; or by magnetic attraction to a metal or metallic substrate by action of at least one magnet member disposed in a front surface; whereby a plurality of different-sized socket heads, stored with at least a portion protruding exteriorly to enable ready access, retrieval, and replacement by a user, is conveniently locatable proximal said user while active upon a jobsite.

FIELD OF THE INVENTION

The present invention relates to a socket storage and portage apparatus devised to store and port each of a plurality of different-sized socket heads interior to a body member for use securable conveniently located proximal a user operating on a job site. Socket heads are tools frequently employed in many professions, and any job frequently requires use of different-sized socket heads for engaging screws and fasteners and the like. Many such professions requiring use of socket heads, for example, situate their employees interior to aerial lifts articulated above a bucket truck, to effect repair and maintenance to elevated structures, such as, for example, high voltage transmission lines, signs and cables, and other elevated structures wherein an aerial lift is desirable. The confines of such an aerial lift rarely include a convenient place to store tools or any tool box, say, especially when reaching beyond the confines of the aerial lift proper. Socket heads, which are typically rounded or cylindrical, are apt to roll away from a user if loosely contained in the lift. As metallic objects, such volubility (especially around high voltage lines) can be hazardous.

The present socket head storage and portage apparatus is devised, therefore, for securability in various situations to position a plurality of socket heads within ready reach of a user. A body member is securable to the wall of an aerial lift, for example, by action of a pair of hook members. The body member is thus maintainable elevated against a vertical surface of the wall and each of the plurality of socket heads, arranged by size and accessible protruding exteriorly from the body member along each of a first lateral side and a second lateral side, enables ready access for retrieval and replacement of a desired socket head secured located proximally. A U-shaped notch, disposed in a top side of the body member, includes a bar member disposed spanning thereacross. The body member is thus dependable from the bar member by clipped or tied engagement of the bar member to an overhead structure or object, such as, for example, a bracket, a tie, a pole, wire, or rope, say. For selective securement to metal or metallic surfaces, at least one magnet member is disposed upon a front surface whereby the body member is maintainable against a metal or metallic surface by action of magnetic force.

SUMMARY OF THE INVENTION

The present socket head storage and portage apparatus has been devised to enable convenient location of a plurality of socket heads secured proximal a user working upon a job site whereat a plurality of different-sized socket heads and ratchets may be desirable. The present socket head storage and portage apparatus enables removable securement of each of a plurality of socket heads into a body member, as will be described subsequently, whereby each of the plurality of socket heads protrudes at least a portion exteriorly from said body member for manual retrieval by a user grasping a desired socket head. Each of the plurality of socket heads is securable into the body member by action in contact with a medial wall member, as will be described subsequently. In the preferred embodiment herein disclosed, attachment of each of the plurality of socket heads in contact with the medial wall member is effective by magnetic force.

The present socket head storage and portage apparatus, therefore, includes a parallelepiped body member having a front side, a rear side, a first lateral side, a second lateral side, a top side, and a bottom side. In an example embodiment contemplated as part of this disclosure, wherein the apparatus is devised for use in proximity to high voltage transmission lines or other high voltage sources, for example, the body member is rendered of a non-conductive material such as wood, for example, or a non-conductive polymer.

A plurality of first apertures is disposed serried along the first lateral side of the body member. Each of the plurality of first apertures has a diameter disposed between a minimum diameter and a maximum diameter whereby a range of different-sized socket heads is storable interior to the plurality of first apertures. Each of the plurality of first apertures has a depth devised appropriate to accommodate each of the plurality of socket heads to maintain at least a portion of each said socket head protruding therefrom, whereby a user may expediently remove each said socket head by contacting the exposed portion of each said socket head.

A plurality of second apertures is disposed serried along the second lateral side of the body member. Each of the plurality of second apertures also has a diameter disposed between a minimum diameter and a maximum diameter, but distinct the diameter of each of the plurality of first apertures. A range of different-sized socket heads is therefore storable interior to the plurality of second apertures, said range of different-sized socket heads distinct the range of different-sized socket heads securable into the plurality of first apertures.

Each of the plurality of first apertures has a depth devised appropriate to accommodate each of the plurality of socket heads to maintain at least a portion of each said socket head protruding therefrom, whereby a user may expediently remove each said socket head by contacting the exposed portion of each said socket head. Removable securement of each of the plurality of socket heads into each of the plurality of first and second apertures is effective by contact with a medial wall member disposed along a longitudinal medial axis bisecting the body member. Removable securement may be effected by surface contact with an adhesive element, by action of a partial vacuum formative between the medial wall member and each of the plurality of socket heads, or, per the preferred embodiment set forth herein, by magnetic force.

A cover member may be disposed upon the medial wall member, said cover member devised to protect the medial wall member from direct contact of the wall member with each of the plurality of socket heads. In such embodiments wherein the cover member is practiced, the cover member is permeable to the magnetic force (whereby magnetic attraction is still effective to removably secure each of the socket members in contact with the cover member) but insulative to electrical current whereby conductivity through the body member between socket heads is reduced. Further, the cover member prevents direct forcible contact with the medial wall member whereby the magnetism of the medial wall member is better preserved against repeated impacts effected when returning each of the socket heads subsequent use.

A U-shaped notch is disposed in the top side and a bar member is disposed spanning the notch. The bar member is disposed parallel with the top side. The bar member enables suspension of the body member from clipped engagement around the bar member. Thus use of a carabiner, for example, enables selective attachment of the body member to overlying elongate objects, poles, wires, ropes, brackets, or other objects about which the bar member is securable by clipping or tying engagement.

A pair of insert apertures is disposed upon the rear side. Each of the pair of insert apertures includes an insert portion and a narrows portion devised to securely seat an interconnect portion of each of a pair of hook members, as will be described subsequently. Seating engagement of the interconnect portion into the corresponding narrows portion of the insert aperture is effective when the body member, subsequent insertion of the interconnect portion of each of the pair of hook members into each of the pair of insert apertures, is moved downwards whereby the interconnect portion is engaged into the narrows portion.

Each of the pair of hook members includes a first vertical portion disposed perpendicularly relative each corresponding interconnect portion for lengthwise contact against the rear side of the body member. Each first vertical portion maintains contact with the rear side of the body member to maintain the body portion, when engaged against the interconnect portion, in position secured along the length of each of the said first vertical portions. Each interconnect portion is disposed approximately midway along the first vertical portion whereby the first vertical portion prevents pivoting of the body member upon the interconnect member of each of the pair of hook members due to the contact maintained between the first vertical portion of each of the pair of hook members and the rear side.

Each of the pair of hook members further includes a horizontal portion disposed endwise atop the first vertical portion, a second vertical portion disposed in parallel with the first vertical portion at the other end of the horizontal portion, an inclined diagonal portion disposed angled from the second vertical portion toward the first vertical portion but terminating before contacting therewith, and a rounded portion disposed curving upwardly away from the first vertical portion. Each of the pair of hook member is thus positionable engaged overtop a wall, for example, fittable between the first vertical portion and the third vertical portion whereby the body member may be securely attached against a wall surface, for example, in an aerial lift of a bucket truck say, whereby the plurality of socket heads is locatable proximal a user in the aerial lift when performing work at an elevated job site. The pair of hook members further enable hooking engagement to other objects and surfaces, as desired, which other objects or surfaces are capable of supporting the pair of hooks thereupon. Each of the pair of hook members may include a polymeric sheath or other non-conductive covering to insulate each of the pair of hook members from electrical current when located proximal high voltage sources, for example.

At least one magnetic member is disposed upon the front side. The at least one magnetic member is disposed for magnetic engagement of the body member to a metal or metallic surface whereby the body member may be attached thereto by action of the magnetic force.

Thus has been broadly outlined the more important features of the present socket head storage and portage apparatus so that the detailed description thereof that follows may be better understood and in order that the present contribution to the art may be better appreciated.

Objects of the present socket storage and portage apparatus, along with various novel features that characterize the invention are particularly pointed out in the claims forming a part of this disclosure. For better understanding of the socket storage and portage apparatus, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
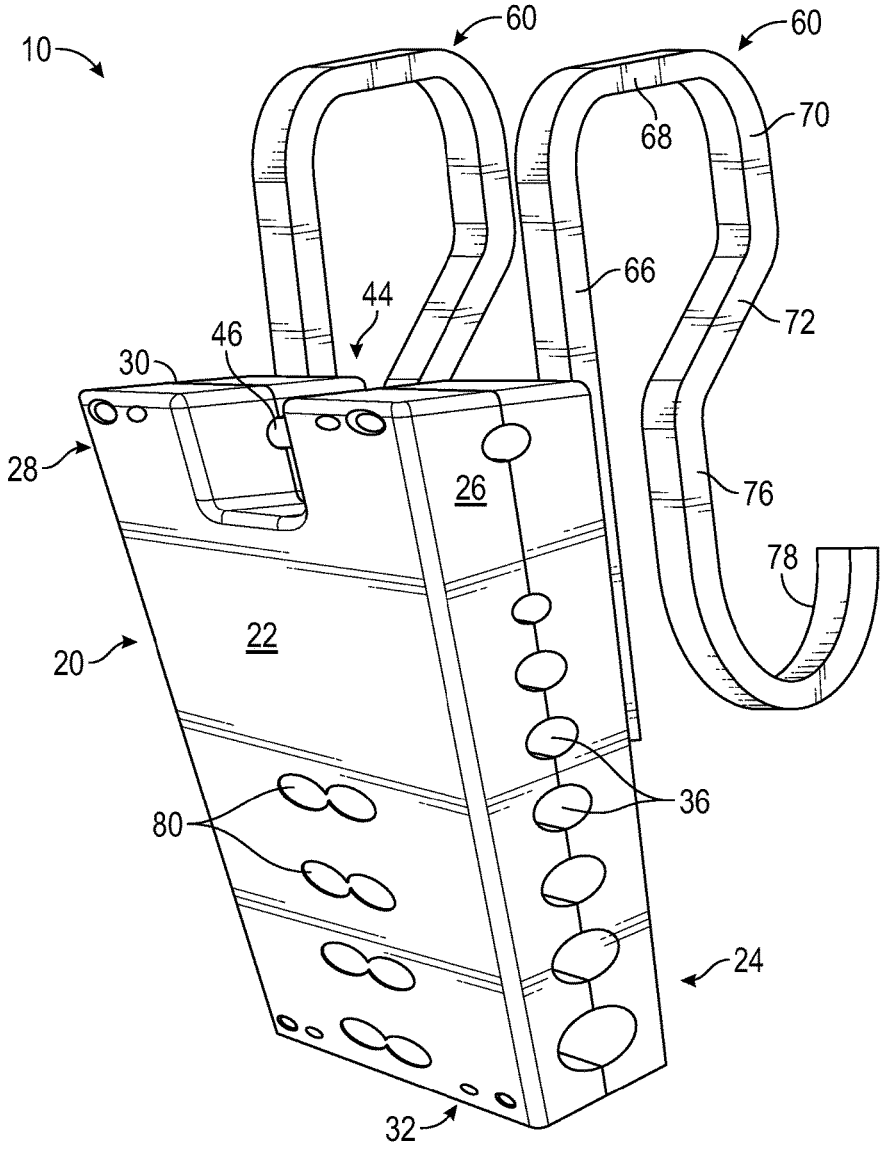
FIG. 1 is an isometric view of an example embodiment.
Figure 2:
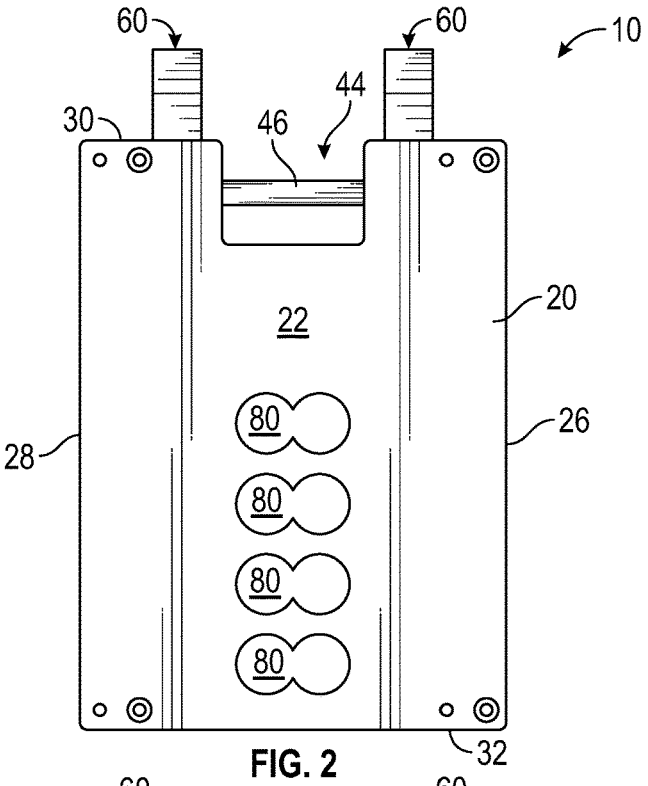
FIG. 2 is a front elevation view of an example embodiment.
Figure 3:
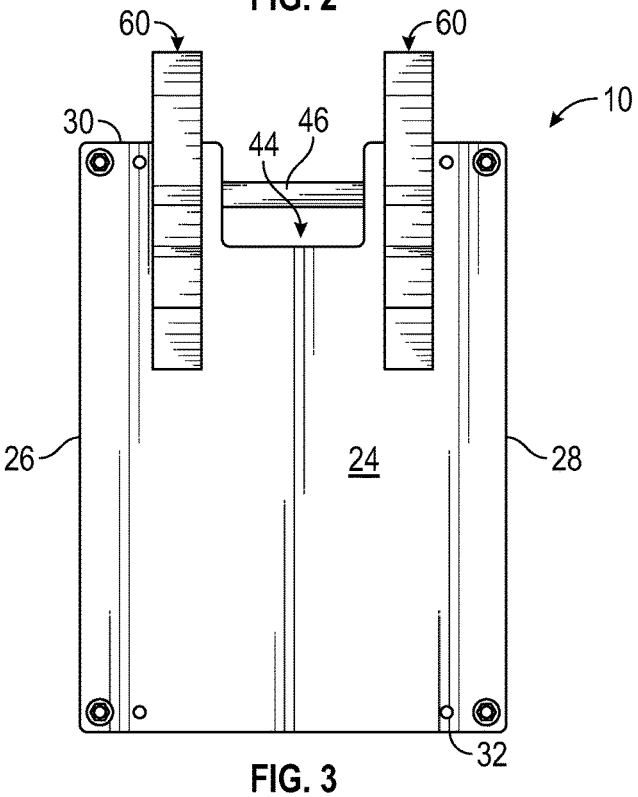
FIG. 3 is a rear elevation view of an example embodiment.
Figure 4:
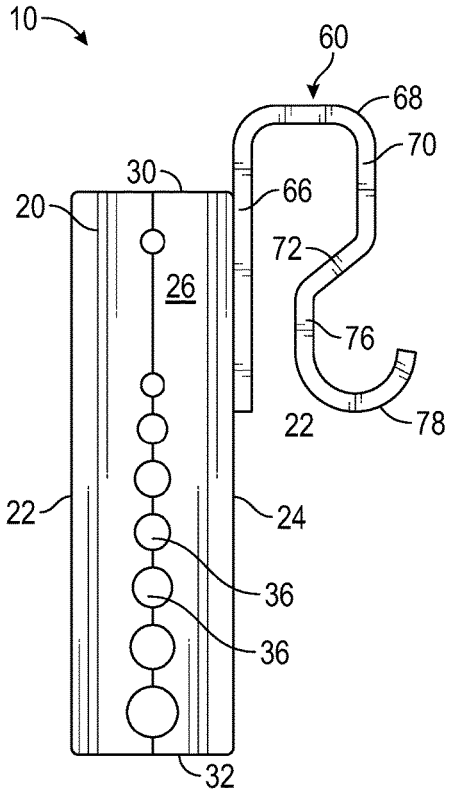
FIG. 4 is a right side elevation view of an example embodiment.
Figure 5:
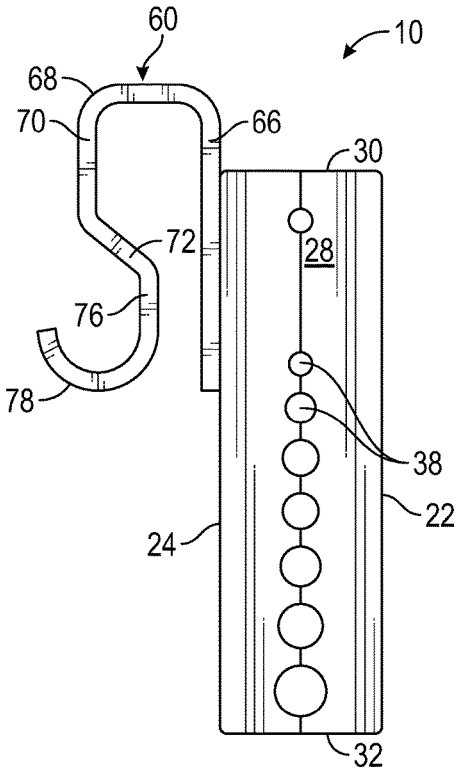
FIG. 5 is a left side elevation view of an example embodiment.
Figure 6:
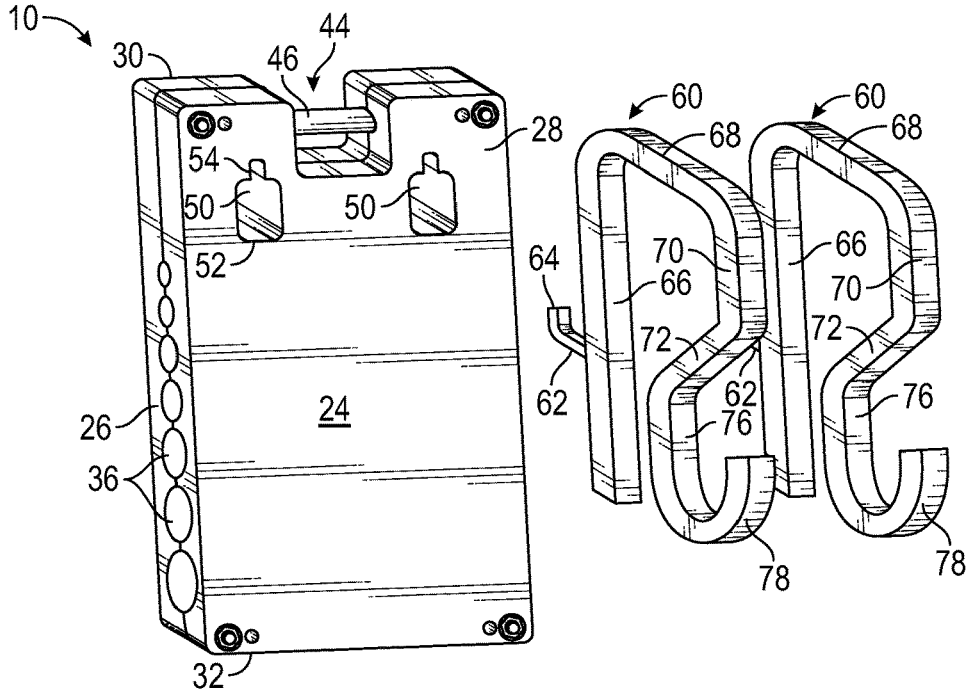
FIG. 6 is a rear elevation view of an example embodiment with a pair of hook members detached therefrom.
Figure 7:
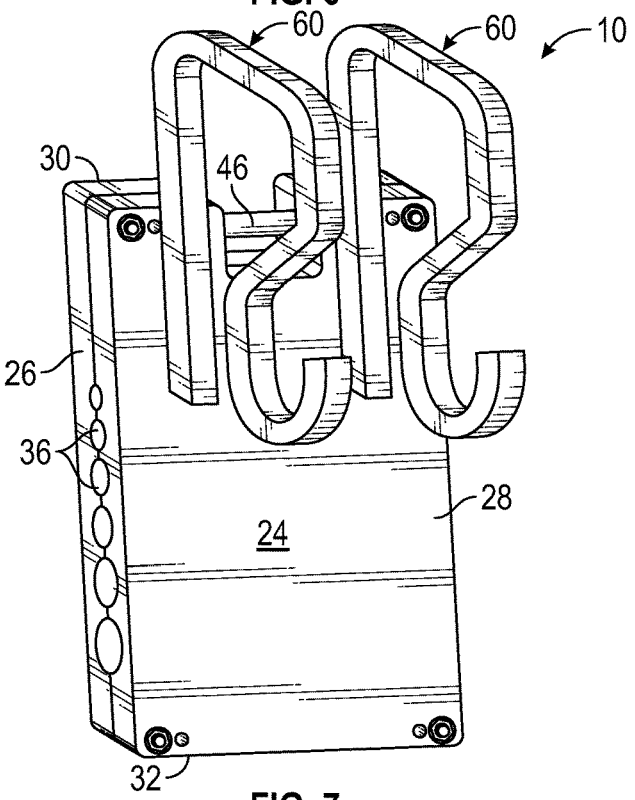
FIG. 7 is a rear elevation view of an example embodiment with the pair of hook members attached thereto.
Figure 8:
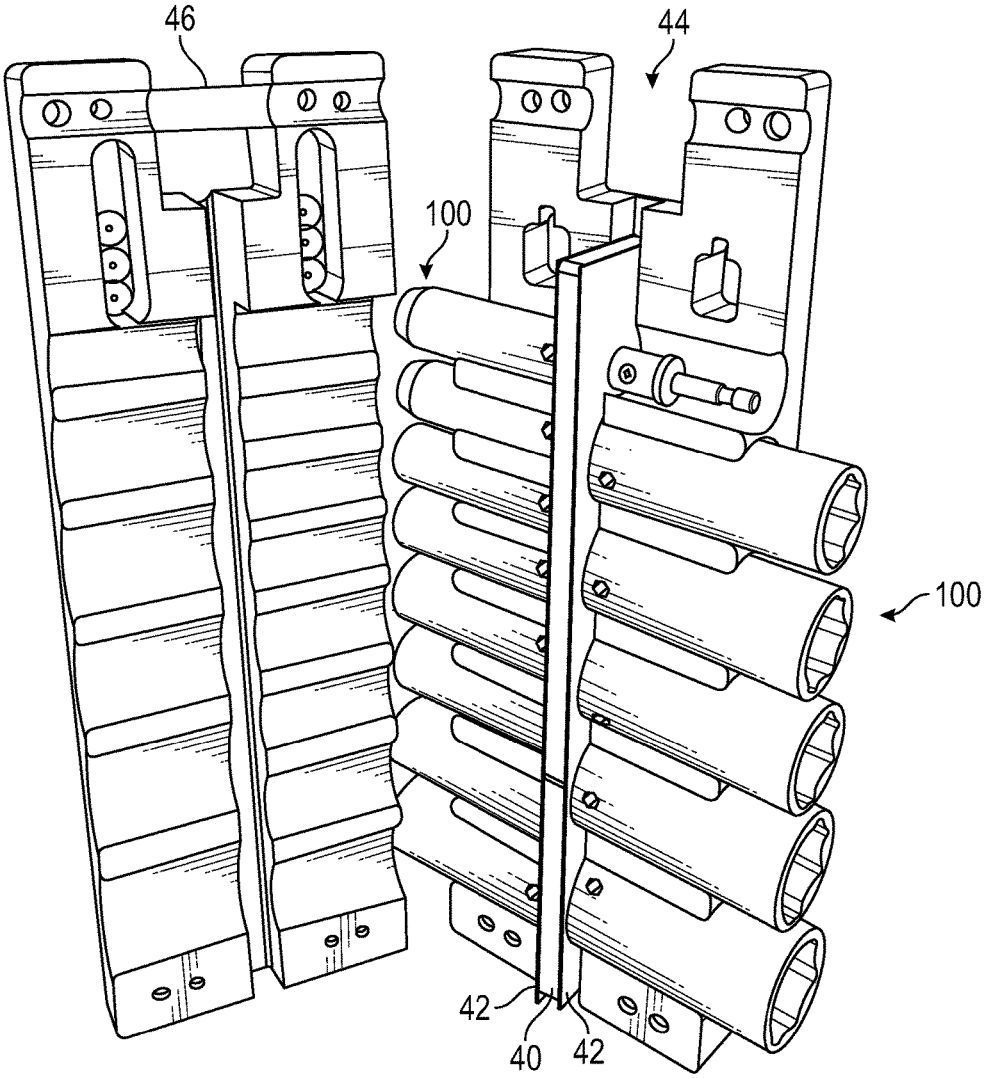
FIG. 8 is a open view of a body member separated along a coronal axis to illustrate an interior.

With reference now to the drawings, and in particular FIGS. 1 through 8 thereof, example of the instant socket head storage and portage apparatus employing the principles and concepts of the present socket head storage and portage apparatus and generally designated by the reference number 10 will be described.

Referring to FIGS. 1 through 8 a preferred embodiment of the present socket head storage and portage apparatus 10 is illustrated.

The present socket head storage and portage apparatus 10 has been devised to enable convenient storage and portage of a plurality of socket heads 100 about a person for use between job sites. The present socket head storage and portage apparatus 10 enables securement of a plurality of socket heads 100 to various surfaces and objects as are typically found at job sites, including, for example, to the side wall of an aerial lift of a bucket truck, an overhead wire, a wall, a bracket, hook, and other such objects and surfaces to which the present apparatus may be attached, as will be described subsequently.

The socket head storage and portage apparatus 10, therefore, includes a parallelepiped body member 20 devised for securely holding socket heads 100 in a situation protruding therefrom for ready retrieval by a user, when needed. The parallelepiped body member 20 includes a front side 22, a rear side 24, a first lateral side 26, a second lateral side 28, a top side 30, and a bottom side 32.

A plurality of first apertures 36 is disposed in the first lateral side 26 for storage of each of a plurality of socket heads 100 therein. Each of the plurality of first apertures 36 has a unique diameter disposed between a maximum diameter and a minimum diameter whereby a range of socket head sizes is storable along the length of the first lateral side 26.

A plurality of second apertures 38 is disposed in the second lateral side 28 for storage of each of plurality of socket heads 100 therein. Each of the plurality of second apertures 38 has a diameter distinct the diameter of each of the plurality of first apertures 36 and each of the plurality of second apertures 38 has diameter disposed between a maximum diameter and a minimum diameter, whereby a second range of socket head sizes is storable along the length of the second lateral side 28.

To releasably secure each of the plurality of socket heads 100 interior to each of the plurality of first apertures 36 and each of the plurality of second apertures 38, a magnetic medial wall member 40 is disposed interior to the body member 20 along a longitudinal medial access therein. The medial wall member 40 bounds an internal extremity disposed between the plurality of first apertures 36 and the plurality of second apertures 38, whereby each of the plurality of sockets 100 disposed interior to each of the plurality of first apertures 36 is endwise disposed in parallel relation to each of the plurality of sockets 100 disposed in each of the second apertures 38 but disposed protruding from an opposite lateral side of the body member 20.

A cover member 42 may be disposed upon the medial wall member 40 to prevent direct contact of the magnetic medial wall member 40 with each of the plurality of socket heads 100 disposed endwise thereagainst. The cover member 42 is permeable to the magnetic force (whereby each of the plurality of sockets 100 is securable against the medial wall member 40) yet protects the medial wall member 40 from direct impact effected when replacing each of the plurality of socket heads 100 as may occur subsequent removal for use. The cover member 40 may also act to insulate the socket heads 100 from each other and thereby lessen electrical conductivity possible through the body member 20 when each of the plurality of socket heads 100 is disposed in each of the first and second apertures 36, 38, as may otherwise occur from arcing, for example, when working proximal high voltage sources. Additional means of securement by contact with the medial wall member 40 are contemplated as part of this disclosure.

A U-shaped notch 44 is disposed in the top side 30 whereat a bar member 46 is disposed spanning said U-shaped notch 44. The bar member 46 is disposed in parallel with the top side 30. A user may, therefore, attach the body member 20 to an overlying object by clipping action, for example, to engage the bar member 46 and depend the body member 20 therefrom. Overlying objects include, therefore, cables, poles, wires, and other longitudinal, elongate members, or brackets, or openings, for example, wherein a clip (such as a carabiner, for example) is securable thereabouts. Thus the body member 20 is securable in depending situation from such objects as may be readily available at a particular jobsite or storage location (such as a hook or protrusion, for example).

A pair of insert apertures 50 is disposed spaced apart upon the rear side 24 of the body member 20. Each of the pair of insert apertures 50 is disposed proximal the top side 30 and on either side of the U-shaped notch 44. Each of the pair of insert apertures 50 is devised for receiving engagement of each of a pair of hook members 60, which hook members 60 are each attachable into each of the pair of insert apertures 50 for engagement therein by securement of an associated interconnect portion 62, disposed perpendicularly projected upon each of the pair of hook members 60, whereby each of the pair of hook members 60 is securable by action of gravity upon the body member 20 to effect seating of each interconnect portion 62 into each of the pair of insert apertures 50, as will be described subsequently.

Each of the pair of insert apertures 50 includes an insert portion 52, disposed to be wider than the width of each interconnect portion 62, and a narrows portion 54, having a width sized appropriate to engage against each associated interconnect portion 62. Insertion of a corresponding interconnect portion 62 into the insert portion 52, therefore, is readily accommodated. Each interconnect portion 62 is then seated into the narrows portion 54 when gravity seats the body member 20 to effect position of each of the interconnect portions 62 engaged into each corresponding narrows portion 54. Each of the interconnect portions 62 may include an upwardly angled end-piece 64, said end-piece 64 thereby engaged interior to the insert aperture 50 to maintain position of the corresponding hook member 60 engaged to the body member 20, as will be described subsequently, until the body member 20 is raised upwardly relative the hook members 60 whereby each interconnect member 62 is disengageable from the insert portion 52 for removal therefrom.

Each of said pair of hook members 60 further includes a first vertical portion 66 disposed perpendicular the interconnect portion 62 for contact against the rear side 24 of the body member 20; a horizontal portion 68 disposed perpendicularly atop the hook member 60, said horizontal portion 68 projected endwise from the first vertical portion 66 and disposed in parallel with the interconnect portion 62; a second vertical portion 70 disposed endwise upon the horizontal portion 68, said second vertical portion 70 disposed in parallel with the first vertical portion 66; an inclined diagonal portion 72 disposed angularly disposed from the second vertical portion 70 towards the first vertical portion 66 to terminate before contacting said first vertical portion 66; a third vertical portion 76 disposed endwise upon the inclined diagonal portion 72, said third vertical portion 76 disposed parallel each of the first and second vertical portions 66, 70; and a rounded portion 78 disposed arced upwardly from the third vertical portion 76.

Each of the pair of hook members 60 may be covered in a polymeric sheath (not shown) to provide a soft surface whereby scratching or damage to a surface contacted by the hook members is preventable and, also, to provide electrical insulation and non-conductivity for use of the present device in proximity to high voltage transmission lines, for example, as may be desirable.

At least one magnetic member 80 is disposed upon the front surface 22 of the body member 20 for magnetic attachment of the body member 20 to metal and metallic surfaces as may be desired. Thus the body member 20 is dependable from an overlying object by clipping engagement at the bar member 46 disposed horizontally spanning the U-shaped notch 44, attachable overtop a vertically oriented edge or other body to which the pair of hook members 60 may engage thereabouts, and magnetically securable to metal or metallic surfaces whereby the plurality of socket heads 100 is conveniently locatable proximal a user working on any particular job site.

What is claimed is:

1. A socket head storage and portage apparatus comprising:

a body member having a front side, a rear side, a first lateral side, a second lateral side, a top side, and a bottom side;

a plurality of first apertures disposed in the first lateral side, each of said plurality of first apertures having a diameter disposed between a maximum diameter and a minimum diameter;

a plurality of second apertures disposed in the second lateral side, each of said plurality of second apertures having a diameter distinct the diameter of each of the plurality of first apertures, each of the plurality of second apertures diameter disposed between a maximum diameter and a minimum diameter;

a magnetic medial wall member disposed interior to the body member along a longitudinal medial access therein, said medial wall member bounding an internal extremity between the plurality of first apertures and the plurality of second apertures;

a notch disposed in the top side;

a bar member disposed spanning the notch, said bar member disposed in parallel with the top side; and a pair of insert apertures disposed spaced apart upon the rear side, each of said pair of insert apertures disposed proximal the top side on either side of the notch;

wherein each of a plurality of different-sized socket heads is securable interior to a corresponding one of each of the plurality of first and second apertures for portage and storage therein, and the body member is securable to an existing wall by engagement of each of the pair of insert apertures and to an existing body by clipping engagement at the bar member horizontally disposed spanning the notch, whereby the plurality of different-sized socket heads is conveniently locatable securely proximal a job site.

2. The socket head storage and portage apparatus of claim 1 further comprising at least one magnetic member disposed upon the front side of the body member wherein the body member is attachable to a metallic surface by action of the at least one magnetic member.

3. The socket head storage and portage apparatus of claim 2 wherein the magnetic medial wall member further comprises a cover member, said cover member permeable to magnetic force but preventative of direct contact of each of the plurality of socket heads with the medial wall member.

4. The socket head storage and portage apparatus of claim 3 further comprising a pair of hook members attachable into each of the pair of insert apertures for engagement therein, each of the pair of hook members comprising:

an interconnect portion disposed perpendicularly projected upon each of the pair of hook members;

a first vertical portion disposed perpendicular the interconnect portion;

a horizontal portion disposed perpendicularly atop the hook member, said horizontal portion projected endwise from the first vertical portion and disposed in parallel with the interconnect portion;

a second vertical portion disposed endwise upon the horizontal portion, said second vertical portion disposed in parallel with the first vertical portion;

an inclined diagonal portion disposed angularly disposed from the second vertical portion towards the first vertical portion to terminate before contacting said first vertical portion;

a third vertical portion disposed endwise upon the inclined diagonal portion, said third vertical portion disposed parallel each of the first and second vertical portions; and a rounded portion disposed arced upwardly from the third vertical section;

wherein each of the pair of hook members is insertible into a corresponding one of the pair of insert apertures whereby the rear side of the body member is engaged in contact against the first vertical portion.

5. The socket head storage and portage apparatus of claim 4 wherein each of the insert apertures comprises an insert portion and a narrows portion, said insert portion configured for receipt of the interconnect portion of a corresponding one of the pair of hook members inserted therein, said narrows portion configured for engagement of said interconnect portion of the corresponding hook member when the body member is subsequently forced downwards, whereby each of the pair of hook members is securable into the rear side of the body portion.

6. A socket head storage and portage apparatus comprising:

a parallelepiped body member having a front side, a rear side, a first lateral side, a second lateral side, a top side, and a bottom side;

a plurality of first apertures disposed in the first lateral side, each of said plurality of first apertures having a diameter disposed between a maximum diameter and a minimum diameter;

a plurality of second apertures disposed in the second lateral side, each of said plurality of second apertures having a diameter distinct the diameter of each of the plurality of first apertures, each of the plurality of second apertures diameter disposed between a maximum diameter and a minimum diameter;

a magnetic medial wall member disposed interior to the body member along a longitudinal medial access therein, said medial wall member bounding an internal extremity between the plurality of first apertures and the plurality of second apertures;

a U-shaped notch disposed in the top side;

a bar member disposed spanning the U-shaped notch, said bar member disposed in parallel with the top side;

a pair of insert apertures disposed spaced apart upon the rear side, each of said pair of insert apertures disposed proximal the top side and on either side of the U-shaped notch;

each of a pair of hook members attachable into each of the pair of insert apertures for engagement therein at each of a interconnect portion disposed perpendicularly projected upon each of the pair of hook members, each of said pair of hook members comprising:

a first vertical portion disposed perpendicular the interconnect portion;

a horizontal portion disposed perpendicularly atop the hook member, said horizontal portion projected endwise from the first vertical portion and disposed in parallel with the interconnect portion;

a second vertical portion disposed endwise upon the horizontal portion, said second vertical portion disposed in parallel with the first vertical portion;

an inclined diagonal portion disposed angularly disposed from the second vertical portion towards the first vertical portion to terminate before contacting said first vertical portion;

a third vertical portion disposed endwise upon the inclined diagonal portion, said third vertical portion disposed parallel each of the first and second vertical portions;

a rounded portion disposed arced upwardly from the third vertical section; and at least one magnetic member disposed upon the front surface;

wherein each of a plurality of different-sized socket heads is securable interior to a corresponding one of each of the plurality of first and second apertures for portage and storage therein, and the body member is securable to an existing wall by engagement of each of the pair of hooks thereover, to an existing body by clipping engagement at the bar member horizontally disposed spanning the U-shaped notch, and alternately to a metallic surface by action of the at least one magnetic member, whereby the plurality of different-sized socket heads is conveniently locatable securely proximal a job site.

7. The socket head storage and portage apparatus of claim 6 wherein the magnetic medial wall member further comprises a cover member, said cover member permeable to magnetic force but preventative of direct contact of each of the plurality of socket heads with the medial wall member.

8. The socket head storage and portage apparatus of claim 7 wherein each of the insert apertures comprises an insert portion and a narrows portion, said insert portion configured for receipt of the interconnect portion of a corresponding hook member inserted therein and said narrows portion configured for engagement of said interconnect portion of the corresponding hook member when the body member is subsequently forced downwards, whereby each of the pair of hook members is securable into the rear side of the body portion.

* * * * *